US006039658A

United States Patent [19]

Cecchin

[11] Patent Number: 6,039,658

[45] Date of Patent: Mar. 21, 2000

[54] GOLF SWING WEIGHT DISTRIBUTION INDICATOR

[76] Inventor: Euclid Cecchin, 3624 Victoria Blvd., Windsor, Ontario, Canada, N9E-5E1

[21] Appl. No.: 09/209,412

[22] Filed: Dec. 10, 1998

[51] Int. Cl.[7] ..... A63B 69/36

[52] U.S. Cl. ..... 473/269; 473/409

[58] Field of Search ..... 473/269, 409, 473/278, 270

[56] References Cited

U.S. PATENT DOCUMENTS

| | | | |
|---|---|---|---|
| 3,169,022 | 2/1965 | Kretsinger | 473/269 X |
| 4,023,810 | 5/1977 | Lorang | 473/269 X |
| 4,577,868 | 3/1986 | Kiyonaga | 473/269 |
| 5,150,902 | 9/1992 | Heisler | 473/269 |
| 5,419,562 | 5/1995 | Cromarty | 473/269 |

*Primary Examiner*—George J. Marlo

[57] ABSTRACT

A golf swing weight distribution indicator and method of determining a golfer's relative weight distribution during a practice swing includes an adjacent pair of weight sensing pads upon which the golfer stands with one foot upon each pad. A pressure sensing device senses the pressure of each foot upon its respective pad at predetermined points in a golf swing, such as immediately prior to the swing, at the end of the back swing and the end of the forward follow-through swing. A display device connected to the sensing device indicates the golfer's pre-swing weight distribution, and the back and forward swing weight distributions. The sensing device and display may indicate the percentage of a golfer's total body weight upon each pad and, therefore, upon each foot for use in analyzing and replicating the golfer's swing.

14 Claims, 2 Drawing Sheets

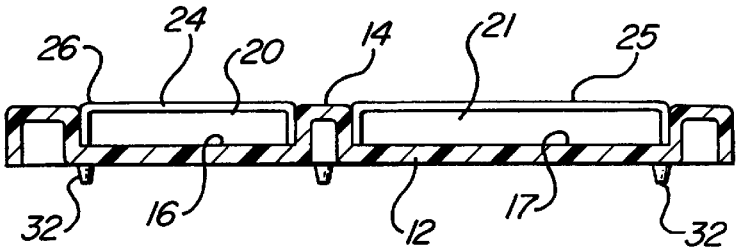
FIG-6
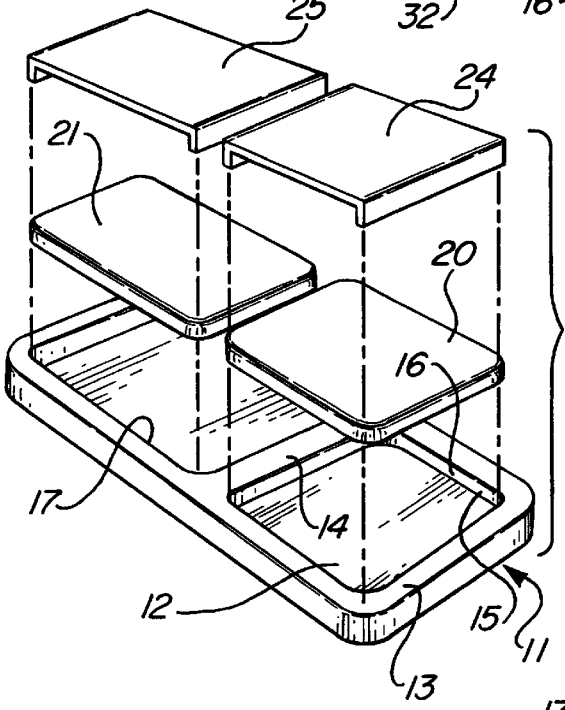
FIG-7
FIG-8
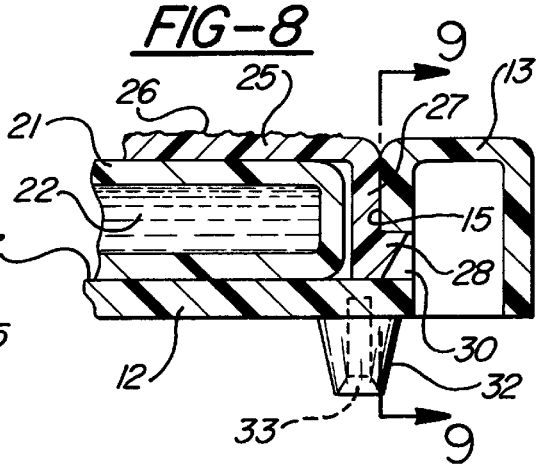
FIG-9
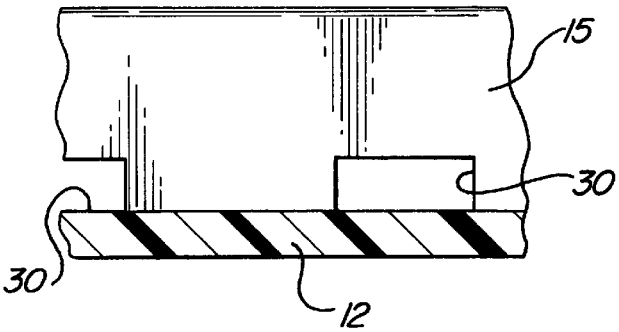
FIG-10
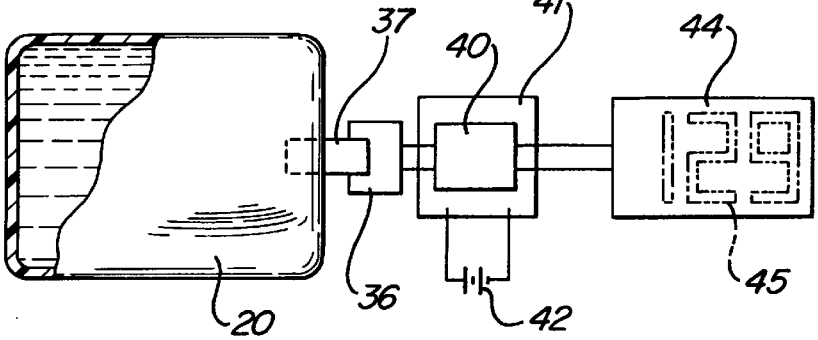

GOLF SWING WEIGHT DISTRIBUTION INDICATOR

BACKGROUND OF INVENTION

This invention relates to a golf training aid which visibly displays a golfer's body weight distribution at several critical times during a drive swing.

As is well-known, maintaining consistency from swing-to-swing, during a golf game, is important to player proficiency. One contribution towards consistency of swings relates to developing, through practice, consistent weight distribution or, more accurately, predictable changes in weight distribution, at certain critical times during the golfer's swing. Thus, it would be desirable to provide a golfer with a means by which the golfer can visually observe his weight distribution during practice swings. Through sufficient practice in attempting to obtain a predetermined weight distribution, the golfer's swing, and the results produced by such swing, may be considerably improved.

The measurement and visual display of the changing weight distribution during a practice swing, which simulates an actual game swing, is difficult. Moreover, it is difficult for the golfer, who is concentrating on the positioning of his body, the club, the ball, etc.—in connection with a swing—to simultaneously observe measurements of the changing distribution of his weight during a swing. Thus, the invention herein is concerned with a simplified, relatively inexpensive, apparatus and method which will detect and visually display the distribution of the golfer's weight at certain predetermined times.

SUMMARY OF INVENTION

This invention relates to a weight distribution indicator, upon which a golfer may stand before and during a practice drive-type swing and which will detect and display the amount of weight upon each of the golfer's feet. The invention contemplates the provision of a pair of pads, positioned within a support platform upon which a golfer stands with a foot on each pad. The pads are located in such a way as to permit the golfer to adjust the relative location of his feet to provide a comfortable stance. The pads are formed of flat, hollow bladders filled with a liquid-like material which will receive and transmit the downward pressure applied by the golfer's feet. A suitable transducer will detect the pressure and pressure changes and transmit—through an electrical signal—the pressure to an electronic circuit which controls a visual display device that visually displays the pressure reading for each of the pads. Preferably, the total pressure of both pads are integrated, that is, combine and the display shows a read-out of the percentage of the total pressure (i.e. percentage of the golfer's weight) on each of the golfer's feet. By observing and repeatedly attempting to obtain the same weight distribution at the start, at the maximum back swing position and at the maximum forward swing position, the golfer can develop consistent drive-type swings. Through sufficient practice, consistent weight distribution will became habitual and, consequently, should result in improved swings.

An object of this invention is to provide an inexpensive, portable, simplified weighing or measuring system for determining the pressure, that is, the weight applied by each of the golfer's feet when the feet are positioned in a comfortable pre-swing stance and, at predetermined critical points in a swing cycle.

Another object of this invention is to provide the golfer with a training aid by which the golfer may repeatedly practice swings which will help to habitually produce similar weight distributions during swing cycles.

Yet a further object of this invention is to provide a simplified weight distribution indicator system and method by which a golfer may repeatedly practice swings and obtain either percentage or actual weight distribution readings during each swing, without the need to adjust or reset or otherwise manually handle the indicator.

These and other objects and advantages will become apparent upon reading the following description of which the attached drawings form a part.

DESCRIPTION OF DRAWINGS

FIG. 6 is a cross-sectional view, to an enlarged scale, taken in the direction of arrows 6—6 of FIG. 4.

FIG. 7 is a perspective, disassembled view of the major parts forming the indicator.

FIG. 8 is an enlarged, fragmentary cross-sectional view taken along one edge of the indicator.

FIG. 9 is an enlarged, fragmentary view taken in the direction of arrows 9—9 of FIG. 8.

FIG. 10 is a schematic view of one of the indicator pads and the transducer, circuit and display associated with that pad.

DETAILED DESCRIPTION OF DRAWINGS

Figure 1:
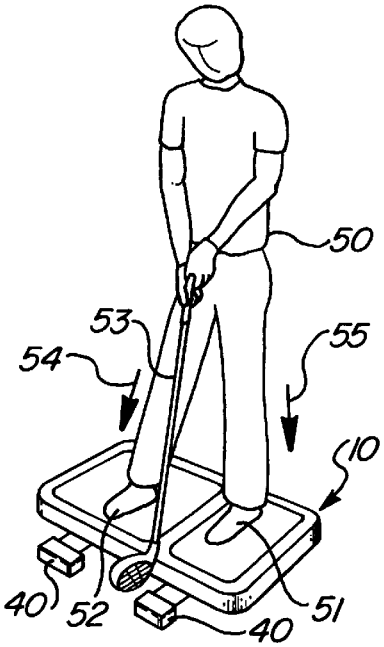
FIG. 1 schematically shows a golfer in a pre-swing stance and diagrammatically, by arrows, shows the substantially equal body weight distribution through the golfer's legs to his feet.
Figure 2:
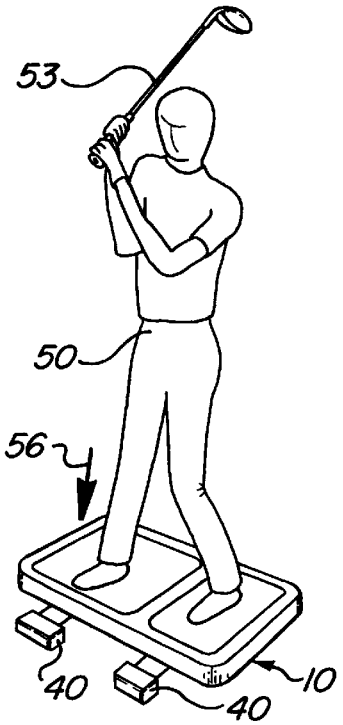
FIG. 2 diagrammatically shows the golfer at the maximum back swing position, with the club raised high and ready to swing downwardly to strike the ball. The weight distribution is schematically illustrated by an arrow at the golfer's right leg.
Figure 3:
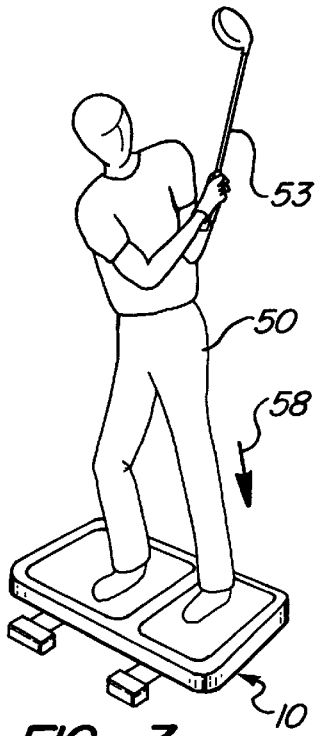
FIG. 3 diagrammatically illustrates the maximum forward swing position, following striking the ball, with the golfer's body weight distribution schematically indicated by the arrow at the left leg.

FIGS. 1–3 schematically illustrate three separate points in a practice swing cycle. FIG. 1 illustrates the golfer in the pre-swing stance, that is, ready to begin a drive swing. FIG. 2 schematically shows the back swing with the club in its maximum height position. FIG. 3 schematically shows the swing completed with the forward swing in its maximum height position. In each of these instances, the golfer is standing upon a weight distribution sensing indicator platform 10.

The platform comprises a tray-like base 11 formed of rigid, sheet plastic or metal material. The base includes a bottom plate 12 having an integral peripheral frame 13 which surrounds the bottom plate 12 (see FIGS. 7 and 8). A middle, cross-strip 14 is integral with the bottom plate and with the opposite sides of the frame 13.

Figure 4:
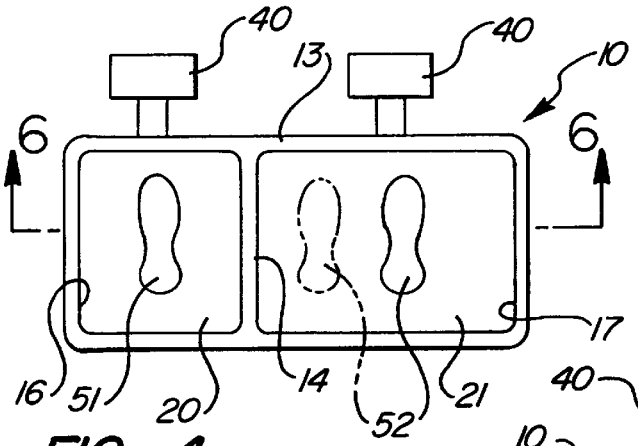
FIG. 4 is a plan view of the weight distribution indicator schematically showing the golfer's left and right foot positions and, in dotted lines, an alternate right foot position.
Figure 5:
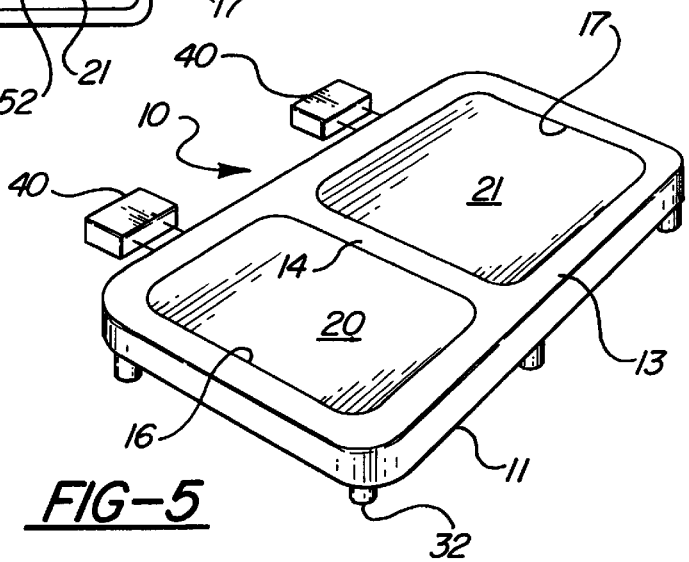
FIG. 5 is a perspective view of the weight distribution indicator.

As illustrated, in FIG. 8, the frame 13 includes a vertical wall 15 which is integral with the peripheral edges of the bottom plate 12. Thus, the frame and the plate and the cross-strip provide two separate depressions or sockets 16 and 17. Preferably, socket 16 is considerably smaller than socket 17 (see FIG. 4).

A pressure-sensitive pad 20 is closely fitted within socket 16. Similarly, a second, larger, pressure-sensitive pad 21 is closely fitted within socket 17. Preferably, each pad is formed of a bladder, which is generally formed like an envelope, that is filled with a viscous filling 22. While water may be used to fill the bladder, preferably the filling is made of a geltype filling, such as a glycol-water mixture which is thicker than water. The filling transmits forces that are applied to the upper surfaces of the bladders.

Each of the pads or bladders is covered with a flexible top sheet or cover. Thus, a flexible cover 24 is applied above the smaller pad 20 and, similarly, a flexible cover 25 is applied over the larger bladder 21. The upper-surfaces 26 of the covers are roughened to simulate ground-like surfaces. The peripheral edges of the covers are provided with integral, depending flanges 27 (see FIGS. 7 and 8) Several tooth-like projections 28 are molded on the edge flanges 27. These projections resiliently snap-fit into corresponding slots 30 formed in the vertical wall 15 which defines the peripheral frame 13 (see FIG. 8).

Preferably, a number of support legs 32, which may be formed of an elastomeric material, are secured at spaced locations, by suitable screws 33, upon the lower surface of the bottom plate 12. These legs support the base 11 upon the ground.

The bladders form support and force transmitting pads. When pressure is applied to the upper surfaces of the bladders, the forces are transmitted through the viscose or semi-liquid fillings to transducers 36 which are connected by connection tubes 37 to the interior of the bladders. Each pad has its own transducer which will transmit electrical signals in response to pressure applied to it through the connector 37 by the compressed bladder fillings.

Signals from the transducers are transmitted through an electrical circuit 40, which may comprise appropriate electrical components mounted upon a circuit board 41 and powered by batteries 42. The circuit, may be varied in its construction and, therefore, is shown schematically. The selection of the detailed construction of, and the electrical components used, are within the skill of the art and are not part of the invention herein. The circuit senses the pressure in the respective pads. Further, the circuit may integrate or combine the total pressures upon the two pads resulting from the golfer's total weight applied upon the pads through the golfer's feet. In that case, the circuit will compare the weight upon each pad with the overall total integrated weight to produce a signal on an LCD display or read-out unit 44 which will display numbers 45, which correspond to percentages of the total weight of the golfer. Two LCD display units 44 may be used, with each indicating the percentage of the golfer's weight applied to each of the pads by the golfer's foot located upon that pad. Alternatively, the circuit can be set to display, on the LCD read-out, the actual weight in pounds or kilograms applied upon each pad.

In operation, the golfer 50 stands with his left foot 51 upon the smaller of the two pads (assuming that the golfer is right-handed) and with his right foot 52 on the larger pad. Typically, the left foot is planted in place with the ball aligned with the inside left heel of the left foot and, in front of the display unit.

Next, the golfer moves his right foot 52 laterally (see dotted lines in FIG. 4) until he obtains a comfortable stance. At this point, the club 53 is held at its lowermost position, that is, where it is about to hit the ball. As illustrated in FIG. 1, arrows 54 and 55 schematically show the approximately equal proportions of body weight applied upon the pad by each of the golfer's two feet.

The golfer then back swings the club, as shown in FIG. 2, at which point the body weight is primarily on the right leg and foot 52, as indicated by the arrow 56. Finally, the forward swing is made and when the club reaches the high point of the follow through, the weight is transferred almost completely to the left foot 51, as shown by the arrow 58 in FIG. 3.

Although other points in the swing can be measured, focusing upon the three points described above, the indicator is arranged to display the body weight distribution at the preswing point of FIG. 1, the back swing point maximum position of FIG. 2, and the forward, follow-through maximum point of FIG. 3. This can be accomplished by a simple timer component in the circuit which, when actuated, i.e. when the golfer is in the pre-swing position, will allow a certain amount of time to reach the maximum back swing position of FIG. 2 and then an additional certain amount of time to reach the follow-through position shown in FIG. 3. In other words, by simply setting the automatic timing, the golfer will automatically get the readings of his three weight distributions. The golfer can get these readings repeatedly by simulating a swing against an imaginary ball or, by swinging against an actual ball.

The measurements of the weight distributions as shown on the display units, can be the target for repetition of each swing until the golfer habitually learns to distribute his weight the same amount for each swing. By observing and analyzing the golfer's weight distributions the golfer can determine the desired or best distribution and corresponding body movements. Then by repeating the desired cycles sufficiently, the golfer will automatically learn to reproduce the same body movement for each successive swing which should result in an improved golf stroke.

This invention may be further developed within the scope of the following claims. Therefore, having fully described an operative embodiment of this invention.

I now claim:

1. A method for indicating a golfer's body weight distribution at predetermined points during a golf swing comprising:

providing a pair of aligned weight sensitive pads upon which a golfer may stand in a swing stance with one foot resting upon one pad and the other foot resting upon the second pad, and with one of said pads being considerably smaller than the second pad and being of a size for relatively closely receiving and supporting one of the golfer's feet without any substantial lateral movement of said foot relative to the pad, and with the second pad being of a larger size to support the second of the golfer's feet while permitting relatively large lateral movements of the golfer's foot rested thereupon for enabling the golfer to freely move the leg laterally in order to assume a comfortable stance prior to swinging;

sensing the pre-swing weights applied by each foot upon its respective pad and visually displaying each of such weights;

sensing and visually displaying each of the weights applied by each foot upon its respective pad when the back swing is substantially completed;

sensing and visually displaying each of the weights applied by each foot upon its respective pad when the follow-through forward swing is substantially completed;

whereby the weight distribution may be analyzed during a full swing cycle.

2. A method as defined in claim 1 and including integrating the total body weight of the golfer and visually displaying the weight applied by each foot at each of said predetermined points as a percentage of said total weight.

3. A method as defined in claim 1 and including visually displaying the weight applied by each foot in a direct numerical weight read-out, such as pounds or kilograms.

4. A method as defined in claim 1 and including sensing and visually displaying the weight applied by each foot upon its respective pad substantially at the point of normal impact of the golf club against a golf ball.

5. A method as defines in claim 1 and including sensing and displaying the maximum weight distribution occurring for each of the back and forward swings.

6. A golf swing body weight distribution indicator for indicating a golfer's weight distribution at pre-determined points during a practice swing, comprising:

a pair of aligned, generally flat pads each being of a size for supporting a golfer's foot when the golfer assumes a golf swing stance, and with one of said pads being considerably smaller than the second pad and being of a size for relatively closely receiving and supporting one of the golfer's feet without any substantial lateral movement of said foot relative to the pad, and with the second pad being of a larger size to support the second of the golfer's feet while permitting relatively large lateral movements of the golfer's foot rested thereupon for enabling the golfer to freely move the leg laterally in order to assume a comfortable stance prior to swinging, each pad being formed of a compressible material which compresses and consequently, produces pressure forces proportional to the weights applied to the pads by the golfer's feet;

each pad having a pressure force sensing device connected thereto which is calibrated for determining the weight applied to its respective pad at pre-determined times during a golf swing, such as immediately prior to the swing, at substantially the maximum back swing and at substantially the maximum forward follow-through swing;

and each pad being connected to a read-out indicator which displays the weights determined by the pad at said times;

whereby a golfer may practice and improve golf swings by observing and attempting to replicate the displayed weights during swing cycles.

7. A golf swing cycle body weight distribution indicator as defined in claim 6, and including said sensing device having a weight integrating circuit which combines the total weight applied by both feet of the golfer at each of said pre-determined times and determines the percentage of total weight applied by each foot upon its respective pad, for displaying the percentages for each foot by the respective read-out indicators.

8. A golf swing body weight distribution indicator as defined in claim 6 and including a generally flat, support plate upon which each of the pads are positioned.

9. A golf swing body weight distribution indicator as defined in claim 8 and with said plate being formed with a pair of adjacent, surface depressions of a size corresponding to and closely receiving and holding one of said pads and with the pads being supported within said depressions to preclude lateral movement of the pads.

10. A golf swing body weight distribution indicator as defined in claim 9, and with each pad being formed of a flat, hollow, envelope-like bladder containing a filling formed of a material which will uniformly transmit pressure forces that are applied upon the upper surface of the bladder by the golfer's feet;

and a transducer connected to each bladder for receiving and sensing such pressure forces from the bladder filling and for transmitting such forces for calibration and display.

11. A golf swing body weight distribution indicator as defined in claim 10, and with said filling comprising a relatively viscous liquid material which will uniformly transmit pressure in all directions in response to said pressure applied to the filling through the upper surface of the bladder.

12. A golf swing body weight distribution indicator as defined in claim 10 and including a flexible cover positioned over the pads, and covering the pads for providing a ground-like surface upon the upper surfaces of the pads, upon which the golfer stands.

13. A golf swing pressure weight distribution indicator as defines in claim 12, and including said sensing device having a weight integrating portion which combines the total weight applied by both feet of the golfer to both of the pads and determines therefrom the percentage of total weight applied by each foot upon its respective pad at each of said predetermined times, and with said read-out-indicators visually displaying said percentages numerically at said predetermined times.

14. A golf swing body weight distribution indicator as defined in claim 6, and including each of the pads being formed of a flat, hollow, envelope-like bladder containing a filling formed of a material which transmits pressure forces equally throughout the filling from pressure forces applied to the filling through the upper surface of the bladder.

* * * * *